US009920506B2

(12) United States Patent
Bomatter

(10) Patent No.: US 9,920,506 B2
(45) Date of Patent: Mar. 20, 2018

(54) FAUCET WITH A QUICK FASTENING DEVICE

(71) Applicant: Franke Technology and Trademark Ltd, Hergiswil (CH)

(72) Inventor: Christian Bomatter, Willer (FR)

(73) Assignee: Franke Technology and Trademark Ltd, Hergiswil (CH)

( * ) Notice: Subject to any disclaimer, the term of this patent is extended or adjusted under 35 U.S.C. 154(b) by 108 days.

(21) Appl. No.: 14/967,791

(22) Filed: Dec. 14, 2015

(65) Prior Publication Data

US 2017/0051479 A1 Feb. 23, 2017

(30) Foreign Application Priority Data

Aug. 20, 2015 (DE) ..... 10 2015 215 865

(51) Int. Cl.
*E03C 1/04* (2006.01)
*E03C 1/02* (2006.01)

(52) U.S. Cl.
CPC ..... *E03C 1/0404* (2013.01); *E03C 1/0401* (2013.01); *E03C 1/0402* (2013.01); *E03C 2001/026* (2013.01); *E03C 2001/0415* (2013.01); *E03C 2001/0416* (2013.01)

(58) Field of Classification Search
CPC ..... E03C 1/0404; E03C 1/0401; E03C 1/0402
USPC ..... 4/676
See application file for complete search history.

(56) References Cited

U.S. PATENT DOCUMENTS 4,848,395 A 7/1989 Krippendorf
6,334,226 B1 1/2002 Tokunaga et al.
8,925,571 B2 1/2015 Li et al.
2008/0098515 A1 5/2008 Yang
2013/0048100 A1 2/2013 Jonte et al.
(Continued)

FOREIGN PATENT DOCUMENTS

CA 2722910 5/2012
DE 19882742 4/1999
DE 69835176 6/2007
(Continued)

*Primary Examiner* — Tuan N Nguyen
(74) *Attorney, Agent, or Firm* — Volpe and Koenig, P.C.

(57) ABSTRACT

A faucet with a faucet housing, a tubular fastening device that is fastenable in a tap hole of a faucet carrier, and one or more flexible connection lines extending through the tubular fastening device to the faucet housing. The tubular fastening device has a tube section that is insertable into the tap hole, a flange that is placeable upon the faucet carrier, as well as an annular collar projecting beyond the flange, on which the faucet housing is fastened. At least two pivotal, longitudinally adjustable fastening clamps are arranged laterally at the tube section, which are adjustable via clamping screws operated from the faucet side against the bottom of the faucet carrier. The fastening clamps are received in the assembled stated in recesses of the fastening device, and pivot therefrom into a fastening position upon operation of clamping screws. The faucet housing has at the fastening side a receiving socket for a form-fitting, torque-proof reception of an annular collar of the tubular fastening device. The faucet is mountable in the pre-assembled state, by the faucet housing with the connection lines, connected thereto and guided through the tubular fastening device, being lifted off the tubular fastening device, inserted in the tap hole, to such an extent that the clamping screws are accessible.

9 Claims, 8 Drawing Sheets

(56) References Cited

U.S. PATENT DOCUMENTS

| | | | |
|---|---|---|---|
| 2013/0180604 | A1 | 7/2013 | Kuo |
| 2014/0265302 | A1 | 9/2014 | Sallah |

FOREIGN PATENT DOCUMENTS

| | | |
|---|---|---|
| DE | 202012104488 | 1/2013 |
| EP | 0293655 | 12/1988 |
| EP | 0866180 | 9/1998 |
| JP | 2002146862 | 5/2002 |

FAUCET WITH A QUICK FASTENING DEVICE

INCORPORATION BY REFERENCE

The following documents are incorporated herein by reference as if fully set forth: German Patent Application No. 102015215865.9, filed Aug. 20, 2015.

BACKGROUND

The present invention relates to a faucet with a faucet housing, a tubular fastening device that can be fastened in a tap hole of a faucet carrier, and one or more flexible connection lines extending through the tubular fastening device to the faucet housing.

Faucets, such as sanitary faucets or sink faucets, are usually fastened by the faucet being placed from the top onto a tap hole of a faucet carrier, thus for example a hand-washing sink, a kitchen sink, or a countertop, and then screw-connected from the bottom with an appropriate annular or a horseshoe-shaped fastening plate at the faucet carrier. This type of assembly has however proven to be expensive and difficult, because frequently the operating space available for the installer underneath the faucet carrier is very limited.

Accordingly, quick fastening devices were suggested for faucets, which can be inserted from the top into a tap hole of a faucet carrier and exhibit at least two fastening clamps that can be laterally pivoted and adjusted in length, which via clamping screws extending inside the fastening device can be adjusted in reference to the bottom of the faucet carrier. The clamping screws themselves can here be operated from the faucet side of the fastening device so that the fastening device can be fastened in the tap hole of the faucet carrier, without it being necessary to perform any work underneath the faucet carrier. The faucet housing is then assembled on said fastening device.

Such a quick fastening device for a faucet is known for example from the Japanese publication JP2002146862. The faucet housing is here placed onto the upper collar of the fasting device. A threaded hole in the collar serves then exclusively for torque-proof fixation of the faucet. The connection lines are only then, after the installation of the quick fastening device, guided through the tubular opening. Here, due to the cumbersome connection bushing with the cap nut required to connect to the corner valves at the wall side, it may be difficult or impossible to push it from the top through the fastening device, so that an installation from the bottom is necessary.

A similar fastening device is also shown in the publication DE202012104488. The faucet shown there is fastened with a type of bayonet closure on the fastening device, thus it must be placed upon at the correct angle and then be locked on the fastening device with a rotary motion of the faucet housing. Due to the fact that there is relatively little space inside the fastening device for the connection lines and additionally the connection lines and a pull-out hose for a pull-out sprayer extend in separate channels through the fastening device, such a rotary motion is only possible if the connection lines have not yet been mounted. Thus, the connection lines must be connected from the bottom to the already fastened faucet, which in turn requires working underneath the faucet carrier.

Another quick fastening device is shown in the publication US 2013/048100. Here, the faucet housing is fastened via an additional molded plastic part, which latches with several flanges at an annular groove in the collar of the fastening device, on said fastening device. The connection lines must be guided laterally through the molded plastic part to a mixing valve. Such a multi-part fastening device is expensive in its production and difficult and time-consuming in the handling during the assembly.

SUMMARY

One objective of the invention is therefore to provide a faucet, which can be assembled quickly and easily.

The objective is attained with a faucet having one or more features of the invention. Advantageous embodiments are discernible from the description that follows and the claims.

In a generic faucet the objective is attained according to the invention such that the faucet housing exhibits at the fastening side a receiving socket for a form-fitting, non-rotatable reception of an annular collar of the tubular fastening device and that the faucet in the pre-assembled state can be fastened on the faucet carrier by the faucet housing with the connection lines, connected thereto and guided through the tubular fastening device, can be removed from the tubular fastening device, inserted in the tap hole, to such an extent that the clamping screws are accessible.

The present invention therefore provides a faucet with a quick fastening device, which can be installed in the pre-assembled state, thus with the already assembled faucet housing and with connection lines guided through the tubular fastening device. This is achieved primarily in that the faucet housing is only plugged onto the fastening device in a defined orientation in reference to each other. For this purpose, the collar, forming the upper end of the fastening device, and the lower end of the faucet housing shaped in the form of a receiving socket for the collar, are embodied such that they form fittings which are non-rotatable in reference to each other.

The faucet is therefore provided in the pre-assembled state and the end of the fastening device at the fastening side only needs to be inserted into the tap hole of the carrier plate. The faucet housing can then be taken off the fastening device such that the clamping screws are accessible by which the fastening clamps are tightened towards the bottom of the carrier plate. Subsequently the faucet housing can once more be plugged onto the fastening device in the predetermined orientation, with the fitting between the collar and the receiving socket providing sufficient support and stability for the fastening. Due to the fact that during or after the placement of the faucet housing onto the fastening device a relative distortion of the two in reference to each other is not required and not possible, either, the pre-assembled connection lines are not in the way and during the assembly they can glide through the interior space of the fastening device without any problems.

Due to the non-rotatable plug-in connection between the faucet housing and the fastening device the faucet may be embodied as a sprayer, in spite of the limited space available inside the fastening device, with the faucet having an outlet with a pull-out sprayer, which is connected via an outlet hose, extending directly through the faucet housing, to the faucet housing. The pull-out hose extends here through the tubular fastening device and in a loop back to a connection located at the bottom end of the faucet housing. Therefore, sufficient space is available in the inner chamber, in addition to the connection line, also for the double pull-out hose, namely guided to and fro. In this embodiment, the faucet is also delivered and fastened in the pre-assembled state, thus with attached connection lines as well as the connected pull-out hose.

The non-rotatable form-fitting connection between the faucet housing and the fastening device can preferably occur such that the collar of the fastening device includes a groove and the faucet housing has a corresponding projection arranged inside the receiving socket. Here, the groove extends preferably parallel in reference to the axial direction of the tubular fastening device.

The form-fitting connection between the faucet housing and the fastening device, free from any play, provides sufficient support and stability to the faucet in reference to the faucet carrier, because the faucet could only be removed from the fastening device perpendicularly in reference to the faucet carrier; however, during normal operation of the faucet here hardly any forces develop. Additionally, at the faucet housing, in the area of the receiving socket, a locking screw is provided to fasten the faucet housing plugged onto the collar. This way, it is prevented that accidentally the faucet housing is pulled off the fastening device. Preferably, the locking screw extends through the projection inside the receiving socket. Based on the increased wall thickness by the projection at this place, here a thread can be inserted particularly well, which provides sufficient support for the locking screw, particularly a headless set screw.

Beneficially, the receiving socket and the collar are embodied cooperating such that the faucet housing can be plugged onto the collar in a purely axial direction in reference to the tubular fixation device.

Due to the non-rotatable connection between the fastening device and the faucet housing the additional difficulty develops that the fastening device, prior to tightening the fastening clamps, must be aligned in the correct position in reference to the faucet carrier so that the outlet of the faucet later points in the correct direction. According to a preferred embodiment of the present invention this is achieved such that the flange of the fastening device exhibits at one side a straightly shaped edge section, which can serve as an alignment mark for the optic alignment of the fastening device in reference to the faucet carrier. The straightly shaped edge section may for example represent the rear section of the faucet so that it can easily be aligned towards a wall or a rear limit of the faucet carrier, such as the edge of a kitchen sink for example. The fastening device can therefore be installed in its correct orientation without it being necessary for the faucet housing to be plugged on for this purpose.

Preferably, a mixing valve is provided in the faucet housing, for example a ceramic disk valve of a single-lever mixer, and the connection lines include a warm water as well as a cold water line.

BRIEF DESCRIPTION OF THE DRAWINGS

Additional advantages and features of the invention are discernible from the exemplary embodiments and the attached drawings. Shown are.

DETAILED DESCRIPTION OF THE PREFERRED EMBODIMENTS

Figure 1:
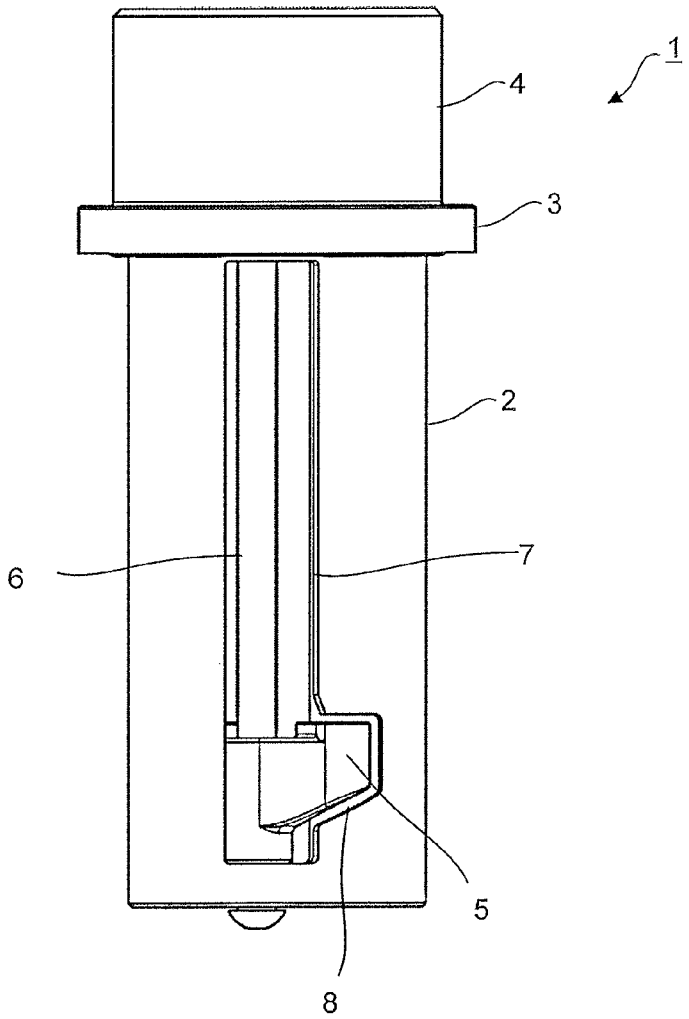
FIG. 1 a quick fastening device for a faucet according to the invention in a side view, FIG. 2 a top view of the fastening device of FIG. 1, FIG. 3 the quick fastening device of FIG. 1 assembled in a faucet carrier, FIG. 4 a faucet according to the invention during the insertion of the fastening device into a tap hole of a faucet carrier, FIG. 5 the faucet of FIG. 3 with a fastening device inserted in the tap hole, FIG. 6 the screwed connection of the fastening device of FIG. 4 in the tap hole, FIGS. 7*a* and 7*b* the screwed connection of the fastening device in the tap hole in a view diagonally from the bottom, FIG. 8 the plugging of the faucet onto the fastening device screwed to the tap hole, FIG. 9 a detail of the bottom end of the faucet housing with the receiving socket for the collar of the fastening device, FIG. 10 the screwing tight of the faucet housing plugged onto the fastening device with the help of a locking screw, and FIG. 11 a cross-section through a faucet housing and a fastening device in a radial plane at the elevation of the locking screw.
Figure 2:
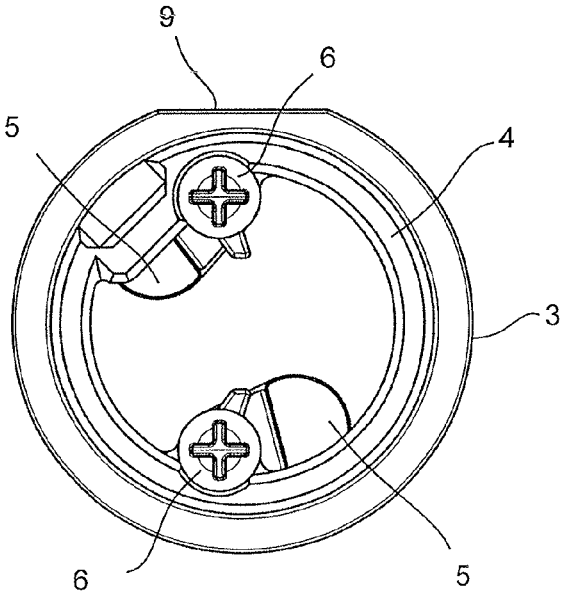
Figure 3:
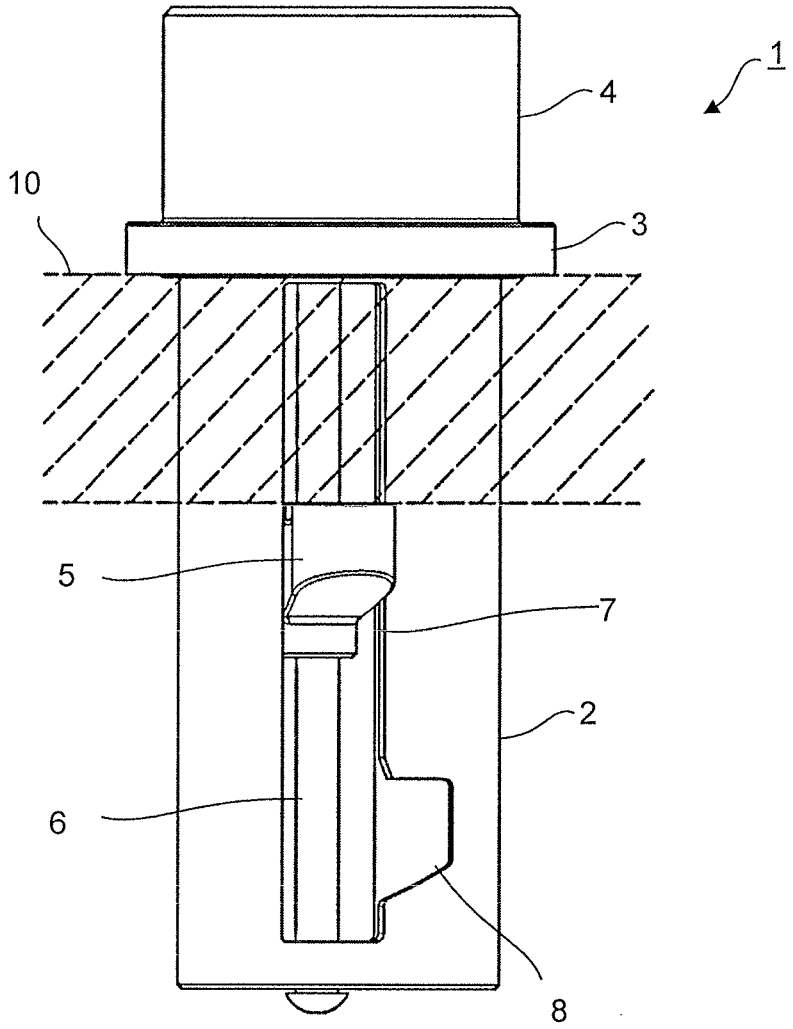

FIGS. 1 to 3 show a quick fastening device for the use with a faucet according to the invention. This represents a tubular fastening part 2, which has in the upper section a flange 3 and an annular collar 4 abutting thereto. Two pivotal fastening clamps 5 are provided at the side of the tube section 2, each adjustable in the axial direction via a clamping screw 6. The clamping screw 6 is located inside the tubular fastening device 1 and the fastening clamps 5 project in the pivoted-out state through slot-shaped openings 7 out of the tubular section 2 towards the outside. In the assembled position shown in FIGS. 1 and 2 the fastening clamps are pivoted inwardly into respective recesses 8, so that they are located inside the perimeter of the tubular section 2. Alternatively the fastening clamps may also be arranged in the assembled position inside its circumference underneath the tubular section 2 in a virtual extension.

In the exemplary embodiment the pivotal motion of the fastening clamps occurs in a radial plane. However it is just as well possible and included in the scope of the present invention that the fastening clamps 5 during operation of the clamping screws fold in a tipping motion out of a vertical into a horizontal direction. The pivoting out of the fastening clamps 5, which may also be a folding out in the above-mentioned sense, can occur, like in the exemplary embodiment, due to friction forces in the thread of the clamping screw 6. Similarly, it is also possible to provide springs, which apply a force in the pivotal direction upon the fastening clamps 5, or to provide wedge-shaped extending guides at the tubular section 2 and/or the recesses 8 so that the pivoting of the fastening clamps 5 occurs based on the wedge-effect by the clamping screws 6 during the axial adjustment.

For the assembly, the tubular section 2 with the fastening clamps 5, pivoted inwardly in the assembled position, can be plugged through a tap hole of a faucet carrier 10, such as a kitchen sink, a countertop, or a wash basin. The flange 3 comprises at one side a straight section 9, which serves as an alignment mark and allows an alignment of the fastening device 1 in reference to the faucet carrier. Subsequently the fastening screws 6 are tightened from the top. Here, initially the fastening clamps 5 pivot outwardly due to the friction in the internal thread until they are abutting the slot-shaped opening 7 at the edge. The pivoted-out position of the fastening clamps 5 is here also called the fastening position, because in this position the fastening device 1 can be held via the fastening clamps 5 and their clamping screws 6 against the faucet carrier 10. By another operation of the clamping screws 6 the fastening clamps 5 are now adjusted upwards in the direction of the flange 3 until they contact the bottom of the faucet carrier. The fastening screws 5 therefore fix via the clamping screws 6 the flange 3 of the fastening device in reference to the faucet carrier 10. This position is shown in FIG. 3.

Figure 4:
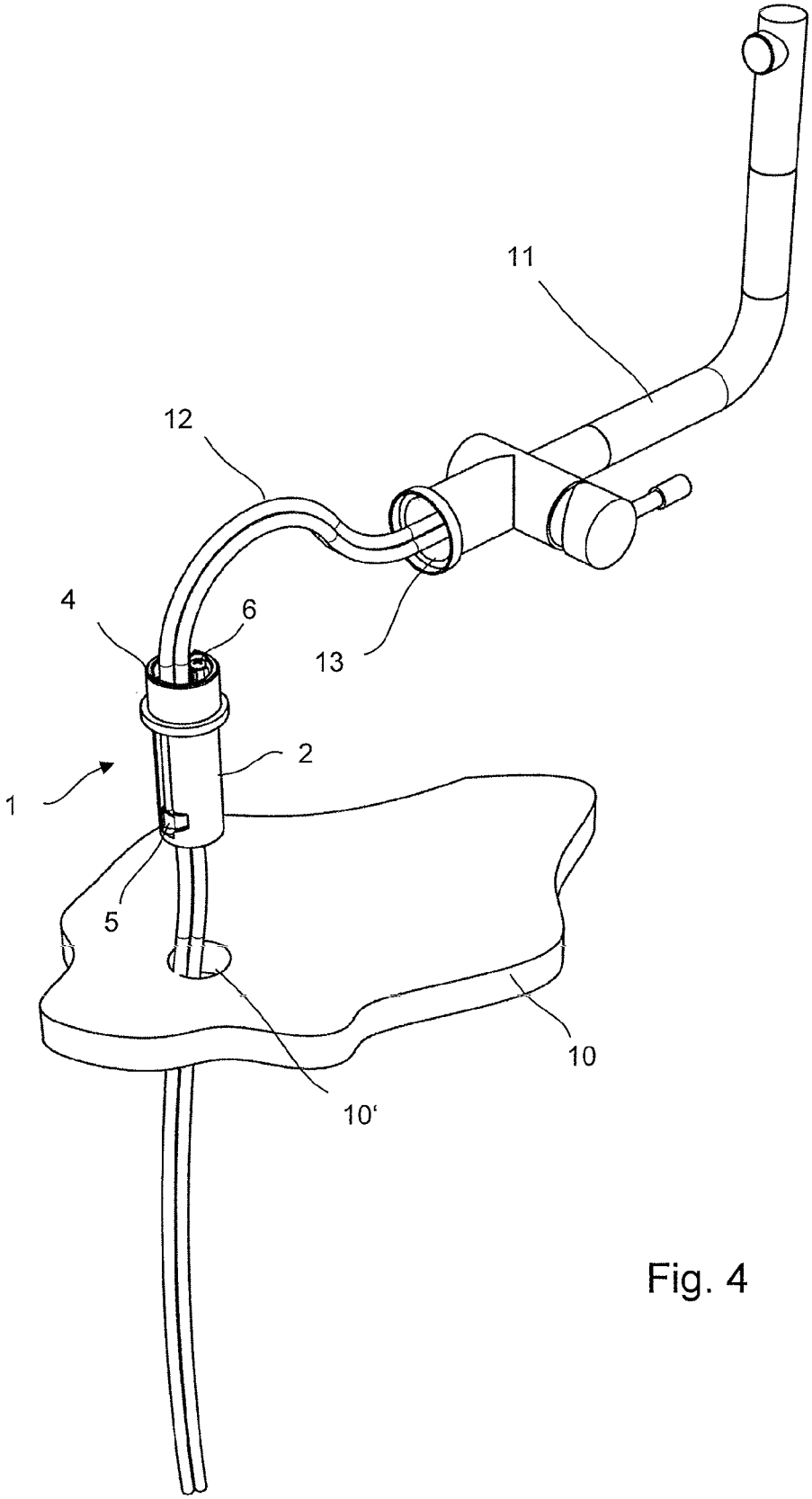

According to the present invention, the fastening device 1 is however not installed separately from the faucet in the tap hole, but the faucet is mounted in the pre-assembled state, thus with the connection lines already connected and guided through the fastening device 1. An exemplary embodiment of such a pre-assembled faucet in an assembled state is shown in FIG. 4. The faucet shows, in addition to the fastening device 1, a faucet housing 11 with connection lines 12 connected thereto. The connection lines 12 are guided through the tubular fastening device 1. At the end of the connection lines 12, facing away from the faucet housing 11, conventional connection sockets with cap nuts are provided for connecting to angle valves of conventional design, which are not shown in the drawings. At its bottom end, the faucet housing comprises a socket 13 which is formed to receive the annular collar 4 of the fastening device 1. The receiving socket 13 and the collar 4 form a fitting, which is sized such that the parts can be inserted into each other manually without play.

Figure 5:
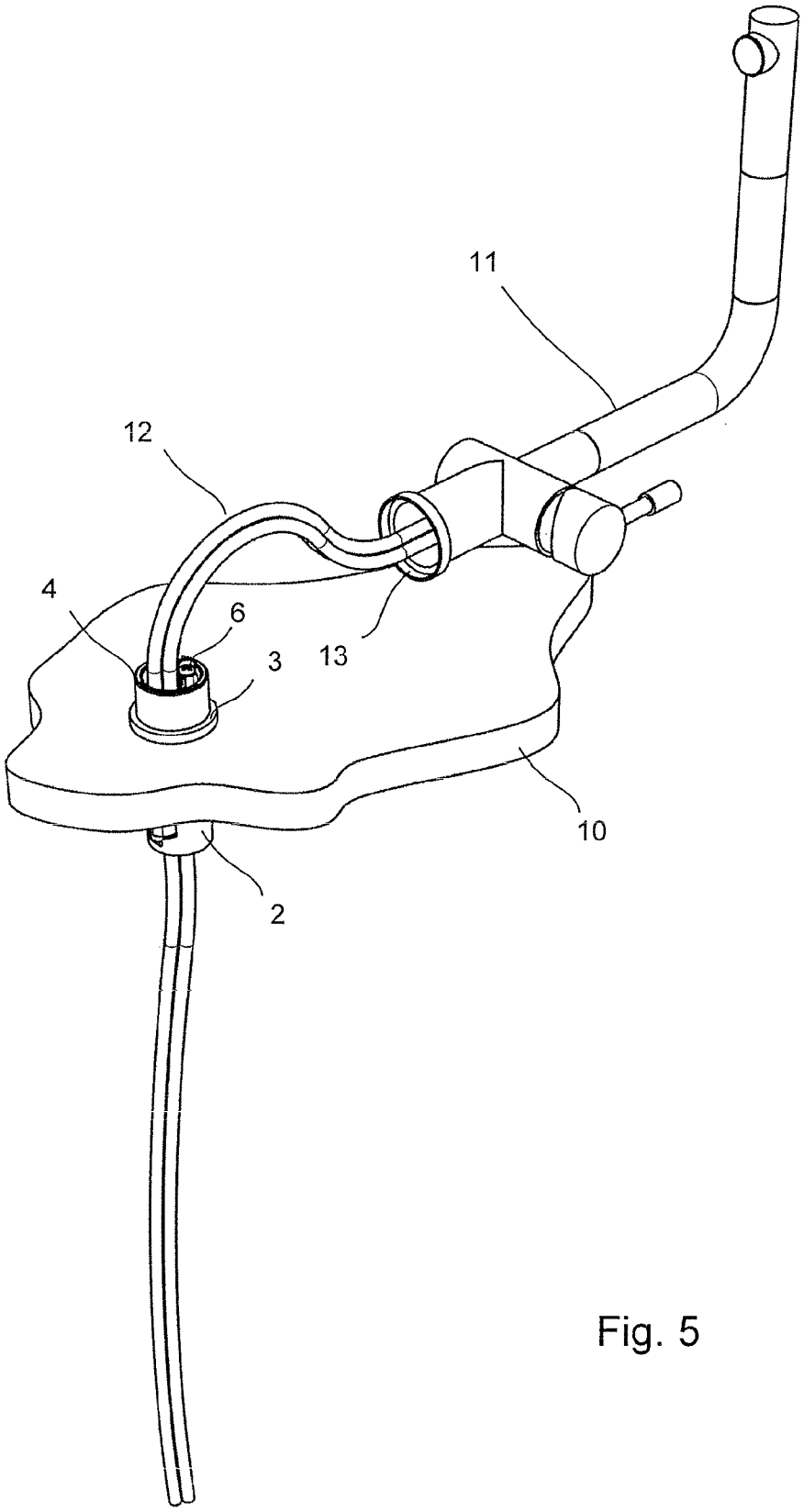
Figure 6:
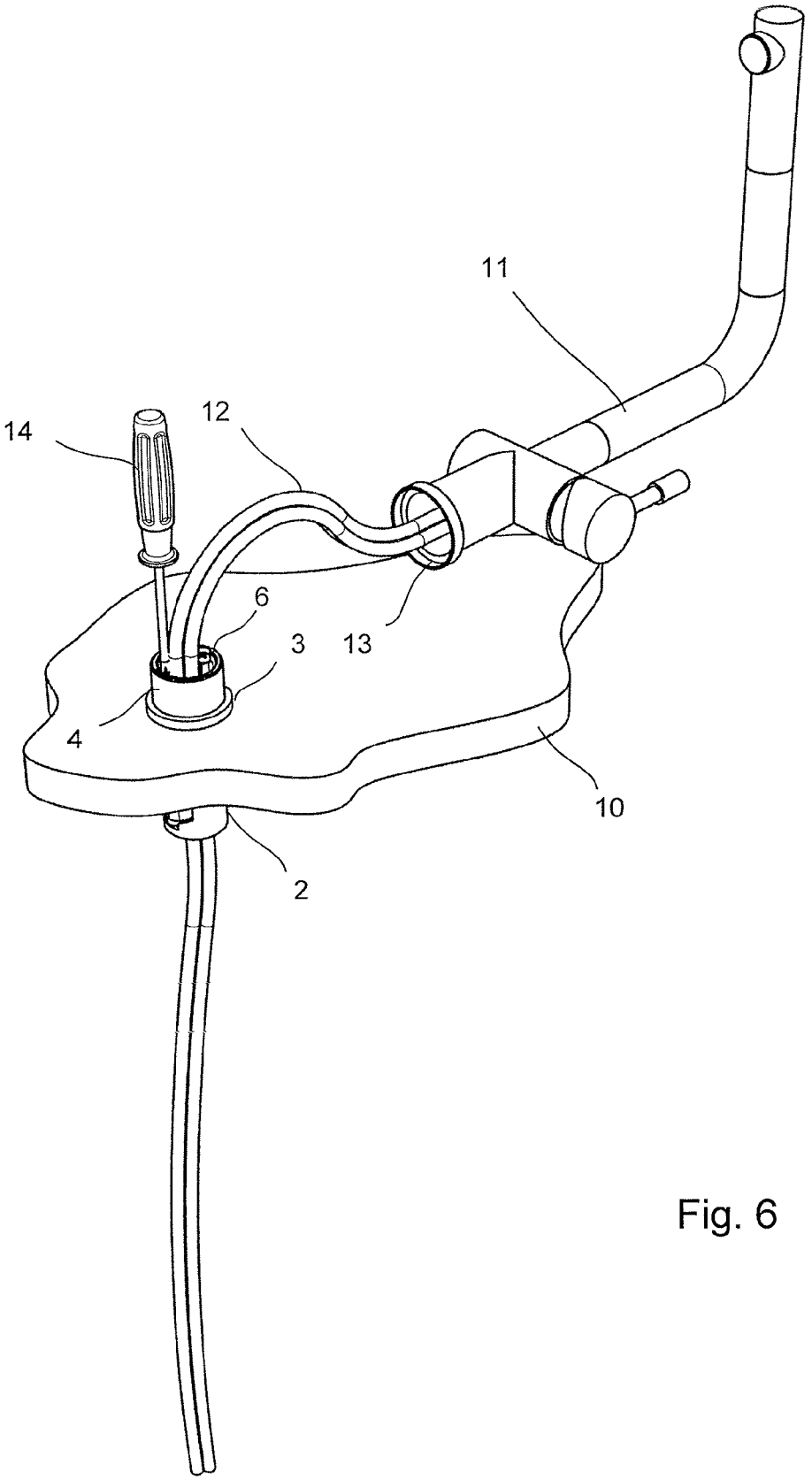
Figure 7A:
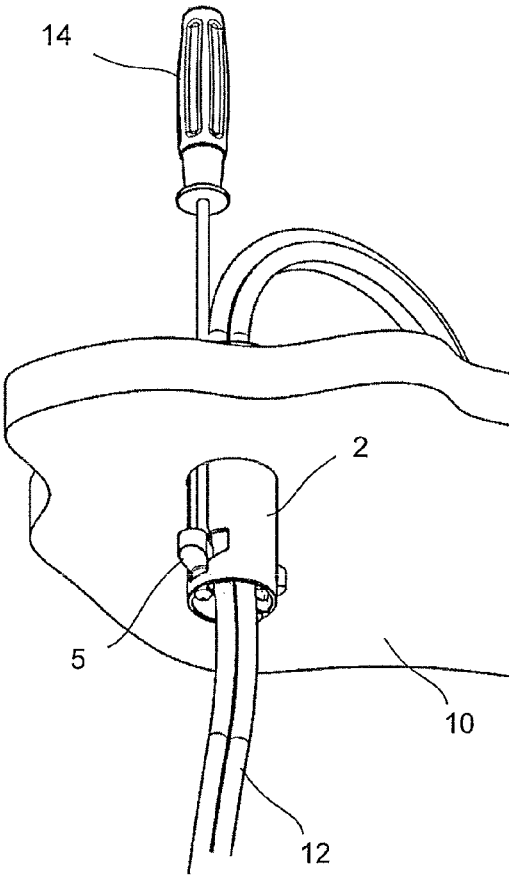
Figure 7B:
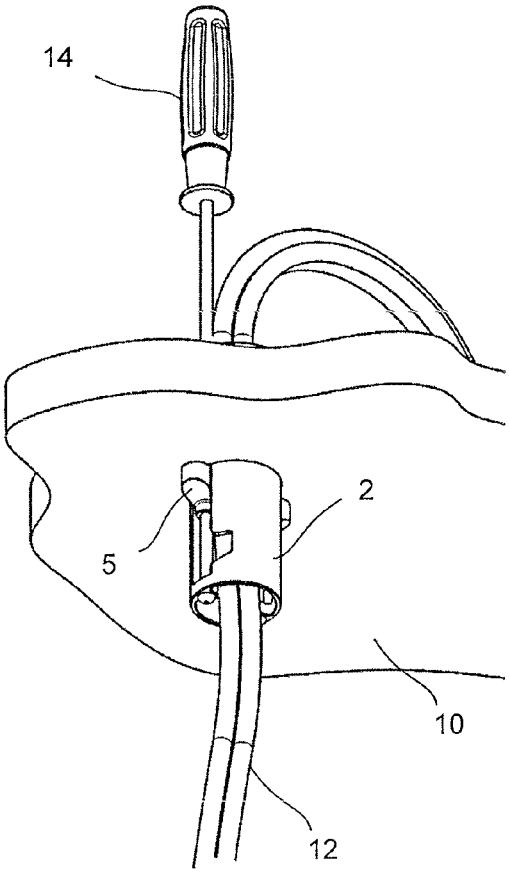

For the assembly the fastening device 1, as shown in FIG. 4, is removed from the faucet housing 11 and inserted into the tap hole 10' of the faucet carrier 10. This state is shown in FIG. 5. Subsequently, with an assembly tool for screws 14, as shown in FIG. 6, for example a screwdriver or a battery-operated screwdriver, the fastening screws are tightened and thus the fastening clamps 5 are initially pivoted out and then tightened towards the bottom of the faucet carrier 10. FIG. 7*a* shows in a view diagonally from the bottom the pivoting out of the frontal fastening clamp 5. By another operation of the corresponding fastening screw the fastening clamp 5 is adjusted to the position shown in FIG. 7*b* at the bottom of the faucet carrier 10 and tightened thereto.

Figure 8:
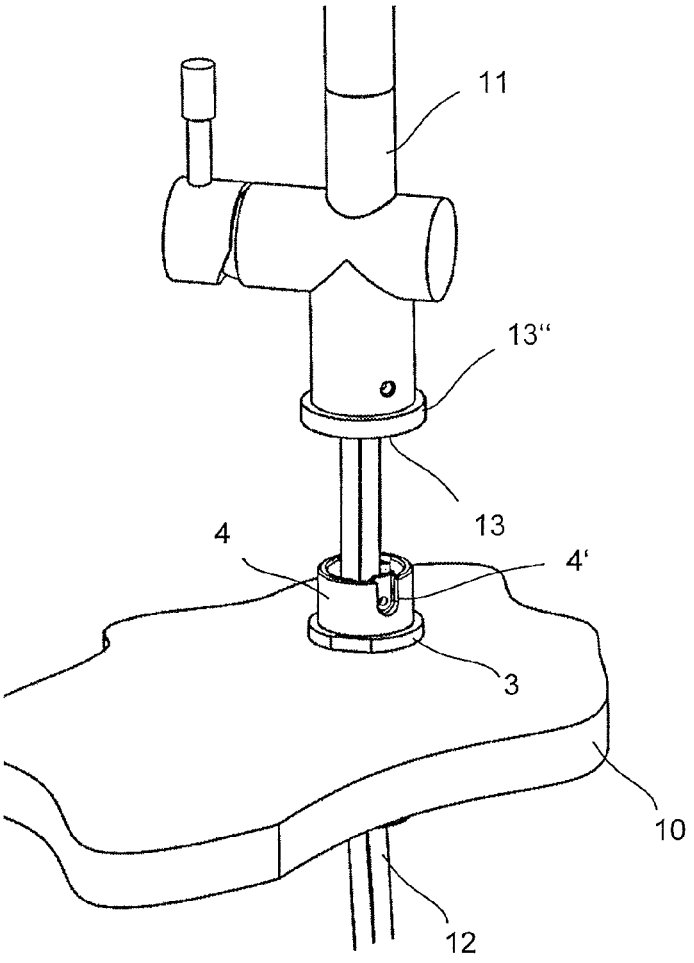
Figure 9:
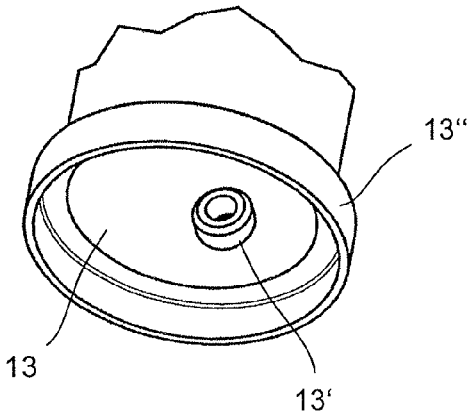
Figure 10:
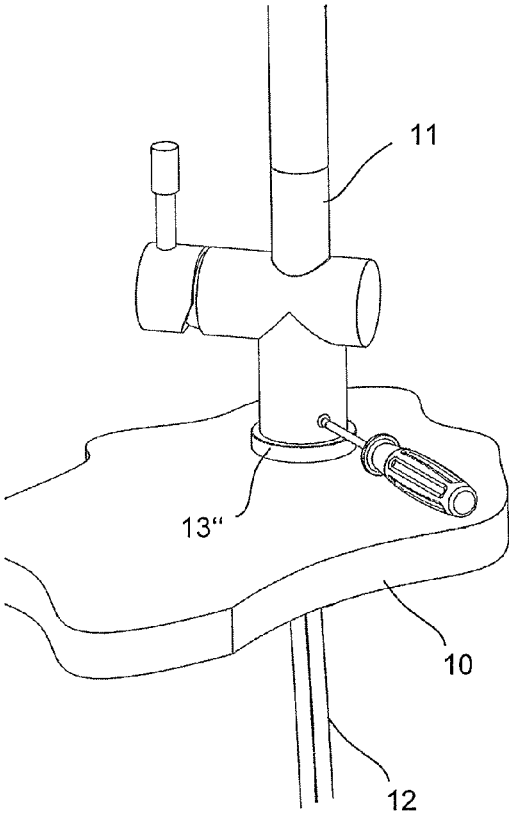
Figure 11:
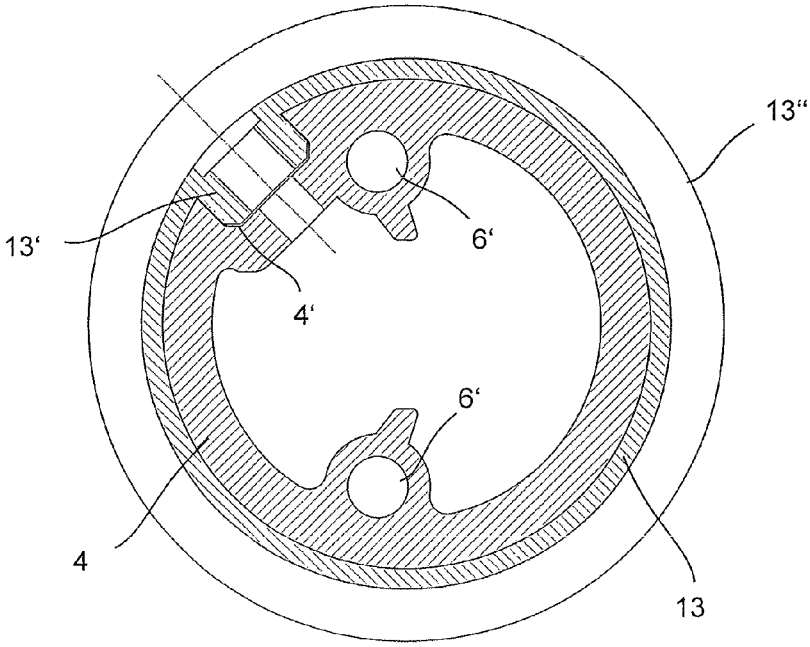

Now the faucet housing 11 is placed onto the fastening device 1, anchored with the help of fastening screws and corresponding fastening clamps in the tap hole 10' of the faucet carrier 10. The plug-in connection between the end collar 4 of the fastening device and the socket 13 of the faucet housing is embodied in a non-rotatable fashion. For this purpose, a groove 4' is provided in the collar 4 of the fastening device, which extends in the direction of the axial extension of the tubular fastening device 1. A projection 13' at the interior of the receiving socket 13 of the faucet housing 11 engages the groove 4' and this way prevents any rotation of the faucet housing 11 on the collar 4. The projection 13' has a radially extending threaded bore, into which a set screw is screwed to secure the faucet housing, as shown in FIG. 8. A cross-section through the faucet housing 11 and the collar 4 at the elevation of the fastening screw is shown in FIG. 9. The fastening screws 6 are guided through the axially extending bores 6'. The connection lines 11 extend in the hollow interior of the fastening device 1.

The lower end of the faucet housing 11 is formed by a radial projection 13" showing an enlarged interior diameter, which serves as a cover like a push-in rosette for the flange 3 of the fastening device 1.

The invention claimed is:

1. A faucet comprising a faucet housing (11) including a control valve and an outlet of the faucet, a tubular fastening device (1) which is fastenable in a tap hole (10') of a faucet carrier (10), and one or more flexible connection lines (12) extending through the tubular fastening device (1) to the faucet housing (11), the faucet housing being in a pre-assembled state with the one or more flexible connection lines (12);

the tubular fastening device (1) comprises a tube section (2) that is insertable into the tap hole (10'), a flange (3) that is placeable upon the faucet carrier (10), and an annular collar (4) projecting beyond the flange (3), on which the faucet housing (11) is fastenable, at least two fastening clamps (5) arranged laterally at the tubular section (2) which are pivotable and longitudinally adjustable, that are adjustable in reference to a bottom of the faucet carrier (10) via clamping screws (6) extending inside the tubular fastening device (1), with the clamping screws (6) being operable from a faucet side of the fastening device (1), the faucet housing (11) comprises at a fastening side a receiving socket (13) for form-fitting and non-rotatable plug-in reception of the annular collar (4) of the tubular fastening device (1) via insertion in an axial direction of the tubular fastening device, the faucet in the pre-assembled state is fastenable on the faucet carrier (10), and the faucet housing (11) with the connection lines (12), connected thereto and guided through the tubular fastening device (1) are lifted off the tubular fastening device (1) insertable in the tap hole (10') to such an extent that the clamping screws (6) are accessible.

2. The faucet according to claim 1, wherein the fastening clamps (5) are accepted in an assembled position in recesses (8) of the fastening device (1) from which they pivot out into a fastening position upon operation of the clamping screws (6).

3. The faucet according to claim 1, wherein the faucet housing (11) comprises an outlet with a pull-out sprayer, which is connected via a pull-out hose extending through the faucet housing (11) to the faucet housing, with the pull-out hose extending through the tubular fastening device (1) and in a loop back to a connection at the faucet housing (11).

4. The faucet according to claim 1, wherein the collar (4) of the fastening device (1) comprises a groove (4') and the faucet housing (11) comprises a corresponding projection (13') arranged inside the receiving socket (13).

5. The faucet according to claim 4, wherein the faucet housing (11) includes a fastening screw in an area of the receiving socket (13) to fasten the faucet housing (11) plugged onto the collar (4).

6. The faucet according to claim 5, wherein the fastening screw extends through the projection (13').

7. The faucet according to claim 1, wherein the receiving socket (13) and the collar (4) cooperate such that the faucet housing (11) is plugged onto the collar (4) in an axial direction in reference to the tubular fastening device (1).

8. The faucet according to claim 1, wherein the flange (3) has at one side a straight formed edge section (9) for visual alignment of the fastening device (1) in reference to an edge of a kitchen sink serving as the faucet carrier (10).

9. The faucet according to claim 1, wherein the faucet housing (1) includes a mixing valve, and the connection lines (12) comprise a warm water and a cold water line.

* * * * *